US010348010B2

(12) United States Patent
Wu et al.

(10) Patent No.: US 10,348,010 B2
(45) Date of Patent: Jul. 9, 2019

(54) CABLE CONNECTOR ASSEMBLY HAVING MINIMIZED CABLE WIRES SIZE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/668,715

(22) Filed: Aug. 4, 2017

(65) Prior Publication Data

US 2018/0040969 A1 Feb. 8, 2018

(30) Foreign Application Priority Data

Aug. 4, 2016 (CN) ..... 2016 1 0631829
Sep. 9, 2016 (CN) ..... 2016 1 0812810

(51) Int. Cl.

| | |
|---|---|
| ***H01R 12/59*** | (2011.01) |
| ***H01R 12/77*** | (2011.01) |
| ***H01R 13/6593*** | (2011.01) |
| *H01R 4/02* | (2006.01) |
| *H01R 24/60* | (2011.01) |

(52) U.S. Cl.

CPC ..... *H01R 12/596* (2013.01); *H01R 12/775* (2013.01); *H01R 12/778* (2013.01); *H01R 13/6593* (2013.01); *H01R 4/023* (2013.01); *H01R 24/60* (2013.01)

(58) Field of Classification Search

CPC .. H01R 12/596; H01R 12/775; H01R 12/776; H01R 13/693

See application file for complete search history.

(56) References Cited

U.S. PATENT DOCUMENTS

| | | | | |
|---|---|---|---|---|
| 8,562,378 | B2 * | 10/2013 | Su | H01R 13/6581 439/607.55 |
| 8,794,995 | B2 * | 8/2014 | Wu | H01R 12/598 439/497 |
| 9,520,677 | B2 * | 12/2016 | Cheng | H01R 13/631 |
| 9,620,910 | B2 * | 4/2017 | Chen | H01R 13/6581 |
| 9,755,368 | B2 * | 9/2017 | Cheng | H01R 13/6471 |

(Continued)

FOREIGN PATENT DOCUMENTS

| | | | |
|---|---|---|---|
| CN | 2409622 | Y | 12/2000 |
| CN | 101958476 | A | 1/2011 |

(Continued)

*Primary Examiner* — Briggitte R. Hammond
(74) *Attorney, Agent, or Firm* — Wei Te Chung; Ming Chieh Chang

(57) ABSTRACT

A cable connector assembly includes: a mating portion; a flat cable electrically connecting with the mating portion, the flat cable having plural wires and an outer boot enclosed the wires, the wires including a first wire and a second wire; an inner mold enclosing a part of the mating portion and a part of the flat cable; and a shielding shell enclosed the inner mold, wherein the first wire is a core wire directly enclosed by the outer boot and the second wire comprises a core wire and an insulative layer enclosing the associated core wire.

16 Claims, 22 Drawing Sheets

(56) References Cited

U.S. PATENT DOCUMENTS

| | | | | |
|---|---|---|---|---|
| 2003/0121694 | A1* | 7/2003 | Grogl | H01B 3/441<br>174/113 R |
| 2006/0228935 | A1* | 10/2006 | Wen | H01R 12/62<br>439/497 |
| 2011/0256764 | A1* | 10/2011 | Wu | H01R 12/598<br>439/607.01 |
| 2014/0307809 | A1* | 10/2014 | Lo | H04B 3/28<br>375/257 |
| 2015/0200473 | A1 | 7/2015 | Chiang et al. | |
| 2016/0079689 | A1 | 3/2016 | Wu et al. | |
| 2018/0040969 | A1* | 2/2018 | Wu | H01R 13/6593 |

FOREIGN PATENT DOCUMENTS

| | | | |
|---|---|---|---|
| CN | 202076611 | U | 12/2011 |
| CN | 202111303 | U | 1/2012 |
| CN | 103608983 | A | 2/2014 |
| CN | 103918129 | A | 7/2014 |
| CN | 104362450 | A | 2/2015 |
| CN | 204144553 | U | 2/2015 |
| CN | 204538369 | U | 8/2015 |
| CN | 204884664 | | 12/2015 |
| CN | 105470668 | A | 4/2016 |
| CN | 105702327 | A | 6/2016 |
| CN | 105702334 | | 6/2016 |
| CN | 105703160 | A | 6/2016 |
| CN | 205429315 | U | 8/2016 |
| CN | 205583296 | | 9/2016 |

* cited by examiner

CABLE CONNECTOR ASSEMBLY HAVING MINIMIZED CABLE WIRES SIZE

BACKGROUND OF THE INVENTION

1. Field of the Invention

The present invention relates to a cable connector assembly, especially to a thin cable connector assembly.

2. Description of Related Arts

U.S. Pat. No. 9,620,910, issued on Apr. 11, 2017, discloses a cable connector including an insulative housing, two rows of contacts, and mating portion, an internal circuit board, and a flat cable. The flat cable includes a row of wires in an outer coating. The wires include plural wire sets each consisting of a first wire and an adjacent second wire, and plural third wires arranged at two sides of each wire set. Anyhow, even though the mating port itself is relatively small, the holding portion behind the mating port is still thicker than the mating port and relatively large, thus essentially occupying more space during using in a compact communication device.

An improved positional structure of the cable to achieve a relatively thin cable connector for miniaturization usage is desired.

SUMMARY OF THE INVENTION

An object of the present invention is to provide a cable connector assembly whose overall structure is thin.

To achieve the above-mentioned object, a cable connector assembly includes: a mating portion; a flat cable electrically connecting with the mating portion, the flat cable comprising a plurality of wires and an outer boot enclosed the wires, the wires comprising a first wire and a second wire; an inner mold enclosing a part of the mating portion and a part of the flat cable; and a shielding shell enclosed the inner mold, wherein the first wire is a core wire directly enclosed by the outer boot and the second wire comprises a core wire and an insulative layer enclosing the associated core wire.

Other objects, advantages and novel features of the invention will become more apparent from the following detailed description when taken in conjunction with the accompanying drawings.

DETAILED DESCRIPTION OF THE PREFERRED EMBODIMENT

Figure 1:
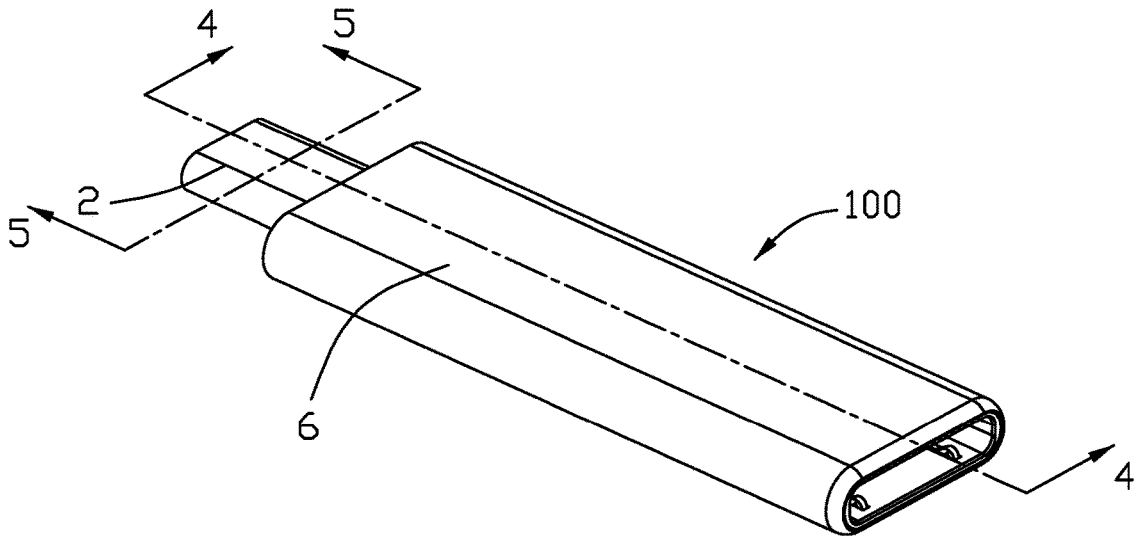
FIG. 1 is a perspective view of a cable connector assembly according to a first of embodiment the present invention.
Figure 2:
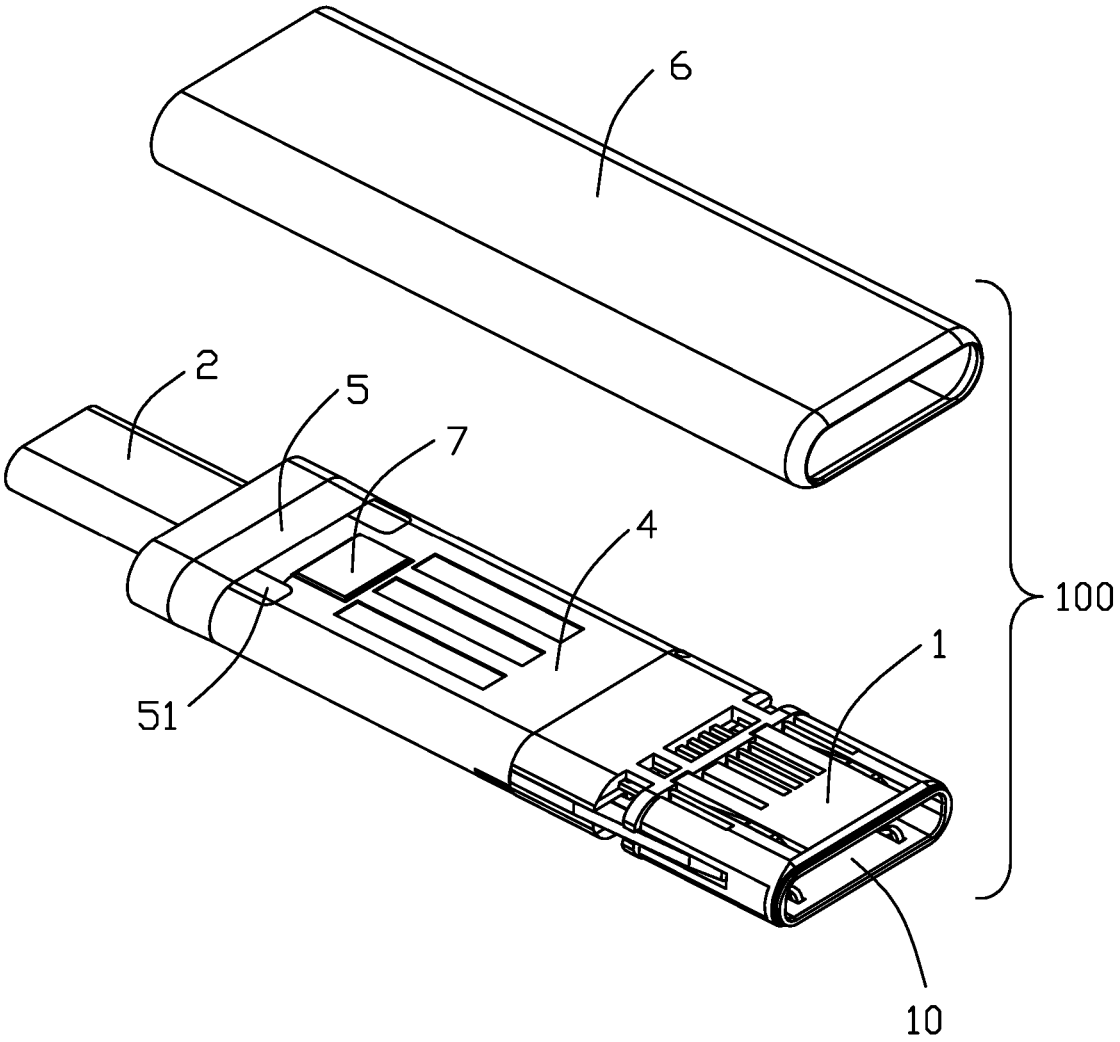
FIG. 2 is a partial exploded view of the cable connector assembly as shown in FIG. 1.
Figure 3:
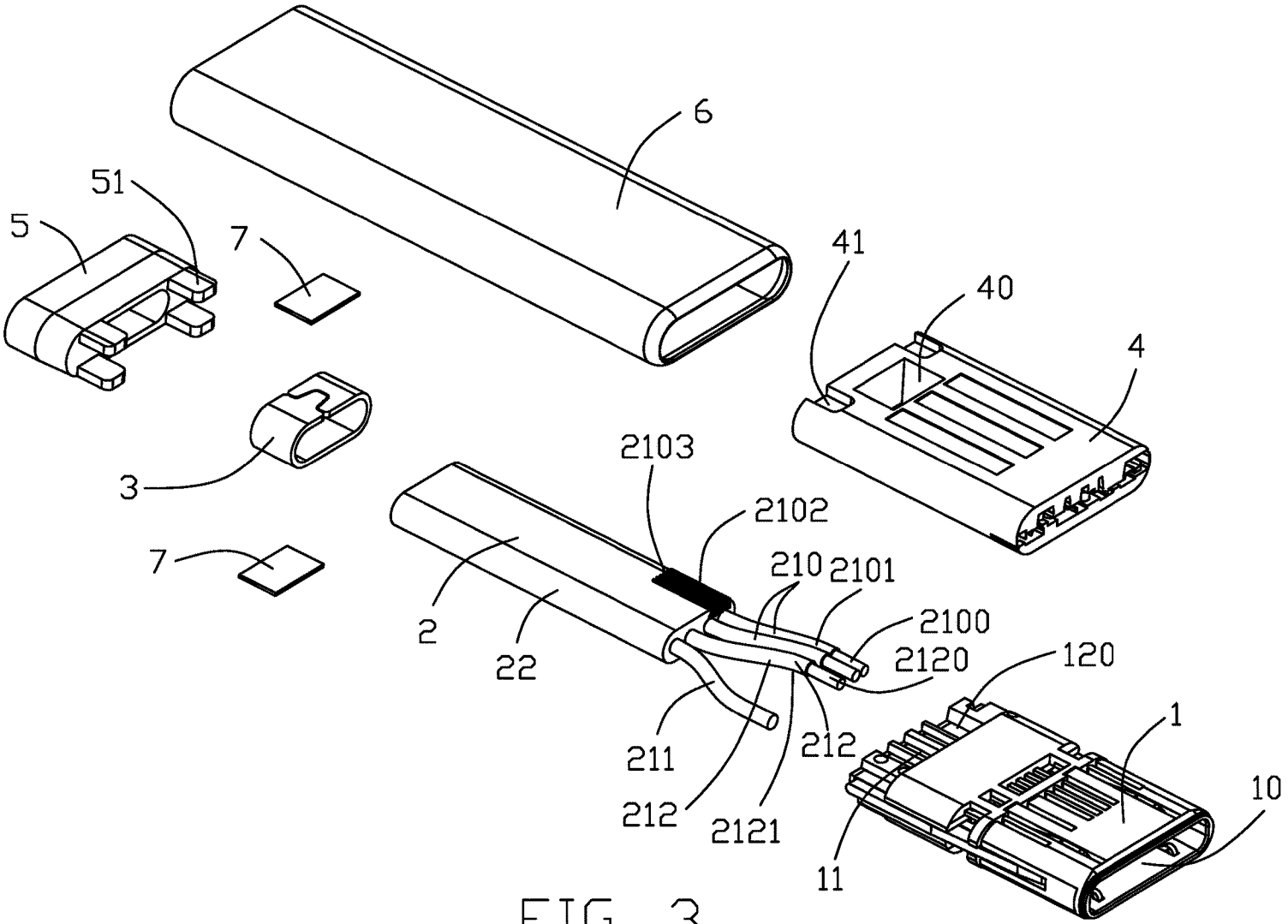
FIG. 3 is a further exploded view of the cable connector assembly as shown in FIG. 2.
Figure 4:
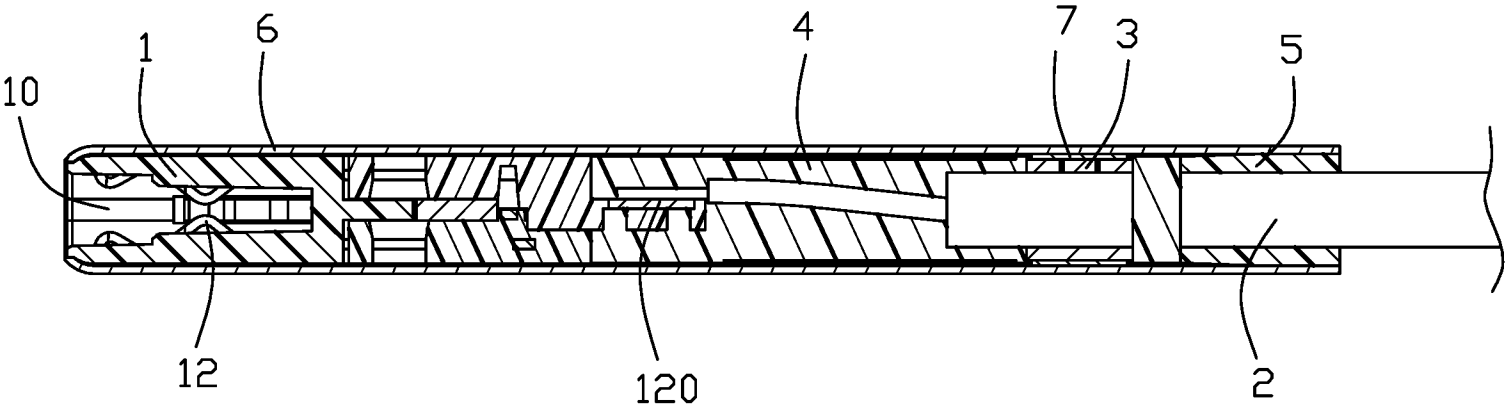
FIG. 4 is a cross-sectional view of the cable assembly taken along line 4-4 of FIG. 1.
Figure 5:
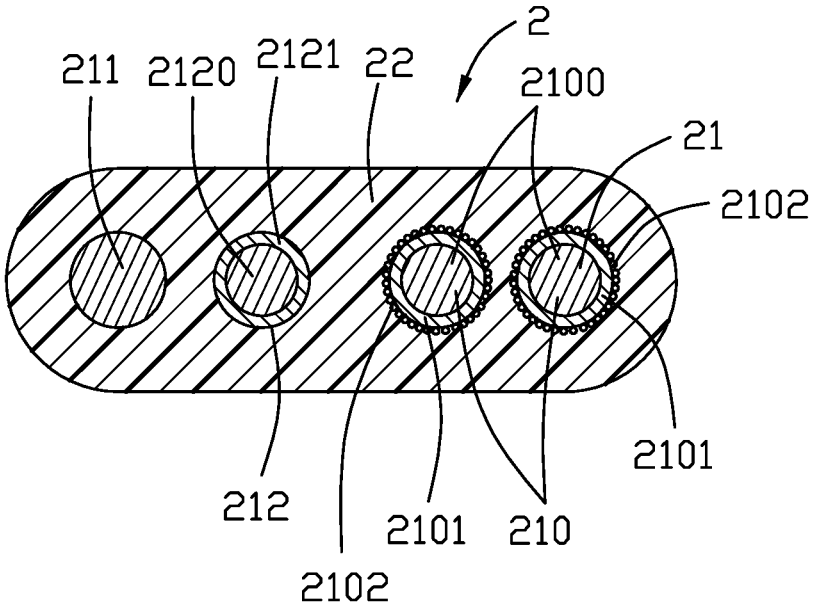
FIG. 5 is a cross-sectional view of the cable assembly taken along line 5-5 of FIG. 1.
Figure 6:
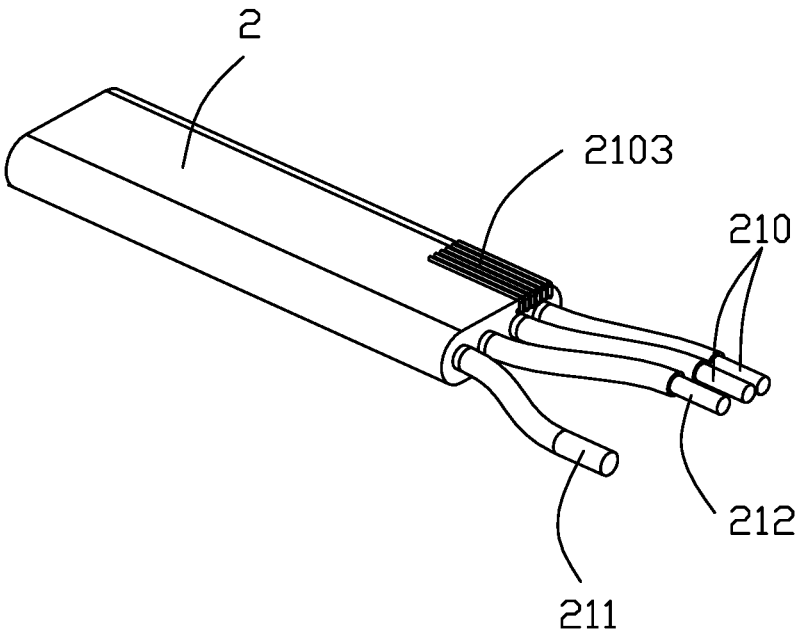
FIG. 6 is a perspective view of an end of the cable.
Figure 7:
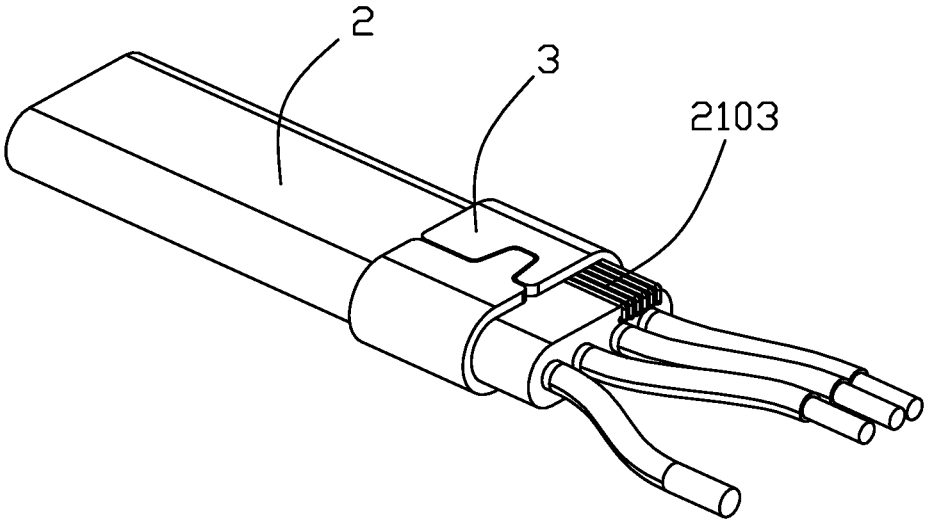
FIG. 7 is a perspective view of a collar crimping the cable on the basis of FIG. 6.
Figure 8:
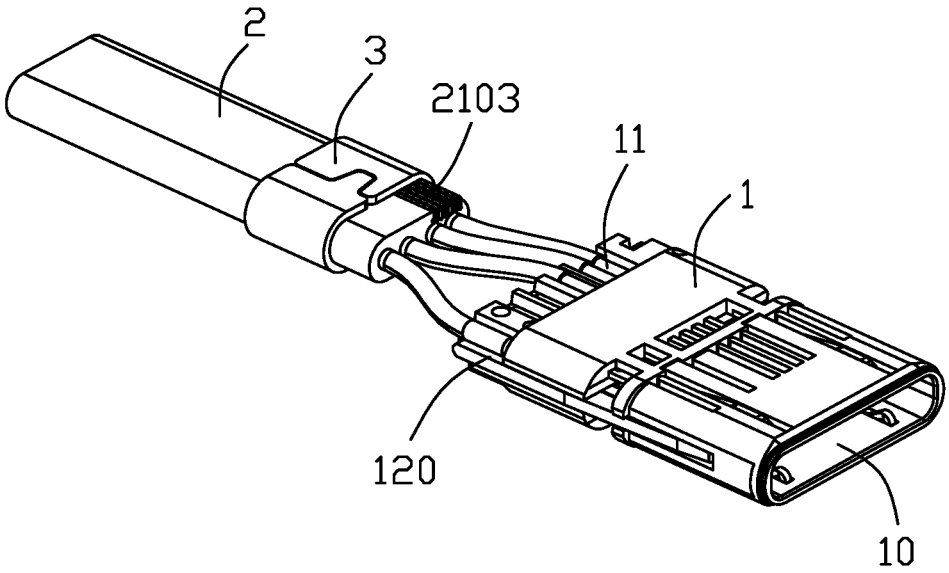
FIG. 8 is a perspective view of the cable shown in FIG. 7 electrically connecting with a mating portion on the basis of FIG. 7.
Figure 9:
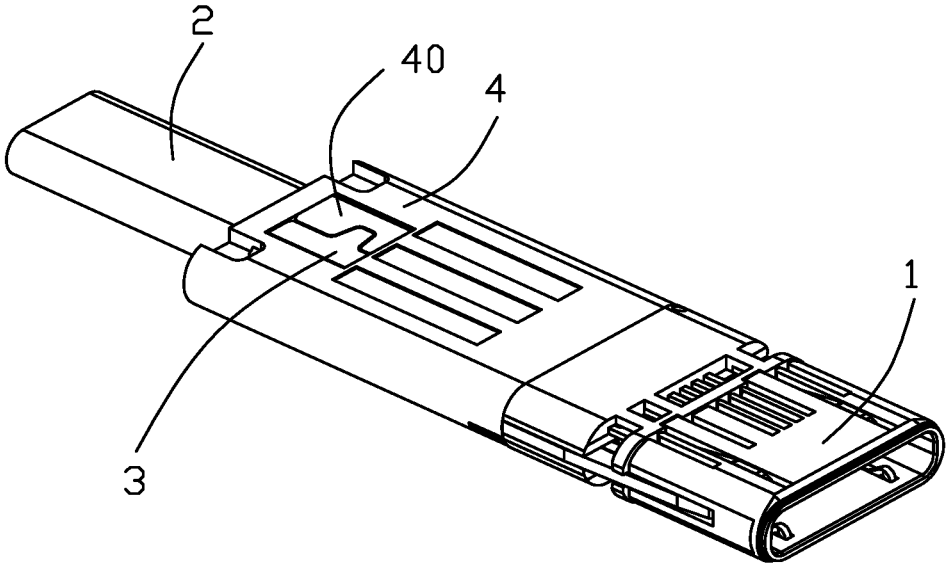
FIG. 9 is a perspective view of the inner mold after forming on the basis of FIG. 8.
Figure 10:
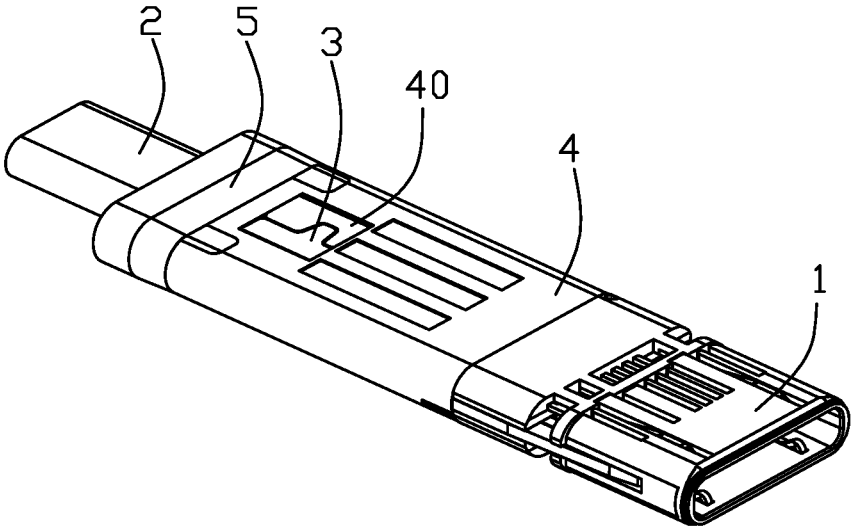
FIG. 10 is a perspective view of mounted a back cover on the basis of FIG. 9.
Figure 11:
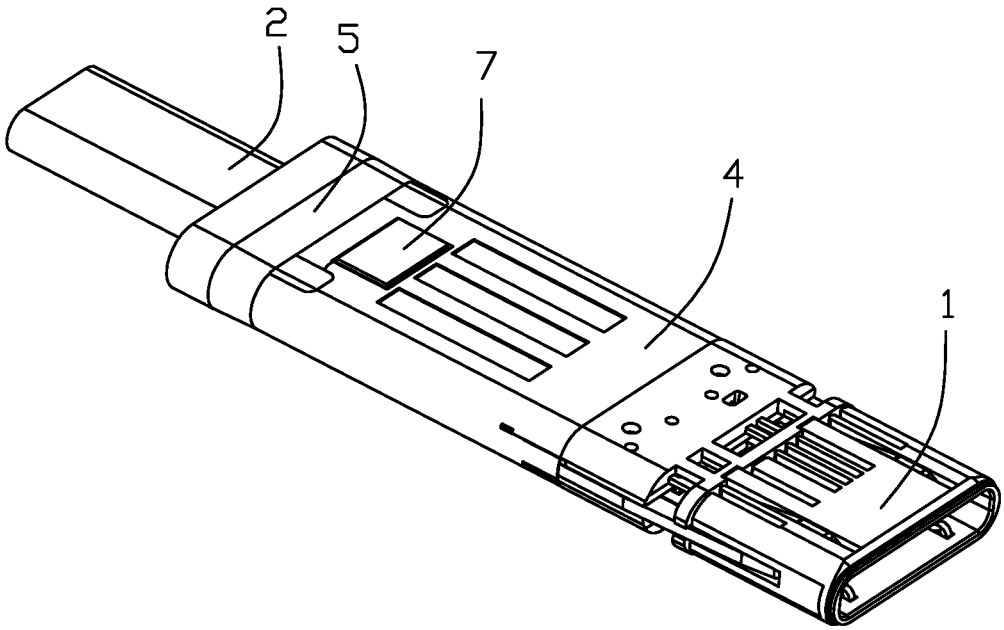
FIG. 11 is a perspective view of mounted a conductive pad on the basis of FIG. 10.

Reference will now be made in detail to the preferred embodiment of the present invention.

Referring to FIGS. 1-11, in a first of embodiment, a cable connector assembly 100 can connect with a mating connector in the two opposite directions. The cable connector assembly 100 includes a mating portion 1, a flat cable 2 electrically connecting with the mating portion 1, a collar 3 crimping on outside of the flat cable, an inner mold 4 enclosing parts of the mating portion 1 and cable 2, a back cover 5 set on the cable 2 and mounted on a rear end of the inner mold 4, a shielding shell 6 and a pair of conductive pads 7 between the collar 3 and the shielding shell 6.

Referring to FIGS. 2-4 and 8-11, the mating portion 1 defines a front open 10 forwardly exposed to an exterior and a receiving recess 11 in rear along the front-to-back direction. The cable connector assembly 100 further includes a number of terminals 12 arranged in two rows opposite to each other in the vertical direction, the terminal has a front contacting section (not labeled) exposed in the opening 10 and a rear soldering tail 120 received in the receiving recess 11. All of soldering tails 120 are arranged in a row. After the mating portion 1 mating with the mating connector, at least a part of the mating connector electrically connects with the terminals 12 through the front open 10.

Referring to FIGS. 3-8, the cable 2 includes a number of wires 21 and an outer boot 22 enclosed the wires 21. The wires 21 include a pair of power wires 210, a ground wire 211 and a signal detection wire 212. The ground wire 211 is a first wire, the pair of power wires 210 and a signal detection wire 212 are a second wire. The pair of power wires 210 transmits a same power signal, the ground wire 211 is a bare wire and directly enclosed in the outer boot 22. The signal detection wire 212 transmits a positive and negative plug signal of the cable connector assembly 100. The power wire 210 includes power core 2100, an insulative layer 2101 enclosed the power core 2100 and a shield layer 2102 set outside of the insulative layer 2101. The shield layer 2102 is formed by spiral wires extending along the cable 2. The shielding layer 2102 uses an ultra-fine conductor helical structure to reduce the thickness of the cable 2 in the case of providing good bending performance. The shield layer 2102 can attenuate the antenna effect of the cable 2. The signal detection wire 212 includes signal detection core 2120 and an insulative layer 2121 enclosed on outside of the signal detection core 2120. By dividing the same signal into two or more wires 21, which can reduced the diameter of each wire 21 in the case of current and voltage, so that the thickness dimension of the cable connector assembly 100 can be reduced. The ground wire 211 uses the bare wire to minimize the diameter of the ground wire 211 as much as possible, so that a thinner thickness dimension of the cable connector assembly 100 can be accommodated. The diameter of the ground wire 211 is larger than the diameter of the power core 2100 and the signal detection core 2120. The specification of the ground wire 211 is 24 AWG (American wire gauge), the specification of the power core 2100 and the signal detection core 2120 is 28 AWG, so that the diameter of the ground wire 211 corresponds to the diameter of the power wire 210 and the signal detection wire 212. The wires 21 expose from an end of the cable 2, in order to the wires 21 easily welds with the soldering portion 120 of the terminals 12. The shielding layer 2102 of the pair of power wire 210 includes an exposed part 2103 turned outside the outer boot 22. The collar 3 crimps the exposed part 2103 and electrically connects with the shield layer 2102. The wires 21 are arranged in a row and are welded to the soldering portion 120 arranged in a row, so that the size of the wire 21 after welding with the soldering portion 120 in the thickness direction is minimized. In other embodiments, the wire 21 may also be electrically connected to the mating portion 1 by a third party, such as an internal circuit board.

Referring to FIGS. 2-4 and 9-11, the inner mold 4 is over-molded the mating portion 1 and the cable 2. The inner mold 4 completely covers welding place of the wires 21 and the soldering portion 120 after molding, the inner mold 4 also covers the collar 3. The inner mold 4 is shaped to form the same width and thickness as the mating portion 1. The inner mold 4 defines an opening 40 in upper and lower surfaces for exposing a portion of the collar 3. A pair of conductive pads 7 is respectively installed in the openings 40. Each conductive pad 7 is electrically and mechanically connected to the collar 3 by means of a conductive paste. The inner mold 4 defines a number of notches 41 on rear end. The back cover 5 has a number of cantilever beam 51, the back cover 5 is fitted to the inner mold 4 by fitting the cantilever beam 51 with the corresponding notch 41. The cantilever beam 51 and the notch 41 may be further bonded together by glue bonding. Thereby maximizing the retention of the cable 2 and enhancing the overall strength of the cable connector assembly 100.

Referring to FIGS. 1-4, the shielding shell 6 is a tubular structure. The shielding shell 6 has a same cross section in the whole front-to-back direction. The shielding shell 6 has a thickness of 2.4 cm and a width of 8.25 cm. The shielding shell 6 enclosed the periphery of the mating portion 1 and the inner mold 4 in a front-to-back direction. When the mating connector is engaged, the front end of the shielding shell 6 is accommodated in the mating connector. The shielding shell 6 is fixedly connected to the inner mold 4 by glue. The cable 2, the collar 3, the inner mold 4 and the shielding shell 6 are formed as a whole, so that maximizing the retention of the cable 2 and enhancing the overall strength of the cable connector assembly 100. Each of the conductive pads 7 is electrically connected to the shielding shell 6, respectively. So that the shield layer 2102 of the power wire 210 is electrically connected to the shielding shell 6 through the collar 3 and the conductive pad 7 to introduce noise of the cable 2 to ground via the shielding shell 6.

Referring to FIGS. 6-11, the method of assembling the cable connector assembly 100 includes the following steps:

(1) Provide the above-mentioned mating portion 1;

(2) Provide the above-mentioned flat cable 2, strip the outer boot 22 of the cable 2 to expose the wire 21, turn the shield layer 2102 of the power wire 210 upon outside of the outer boot 22 to form an exposed part 2103, crimp the collar 2 on the outside of the cable 2 and the exposed part 2103, arrange the wire 21 in a row to electrically connect with the mating portion 1;

(3) Form an inner mold 4 enclosed a part of mating portion land a part of cable 2, form an opening 40 in upper and lower surfaces of the inner mold 4 for exposing a portion of the collar 3;

(4) Mount the conductive pad 7 into corresponding opening 40 and electrically and mechanically connected to the collar 3 by means of a conductive paste;

(5) Set the shielding shell 6 on outside of the mating portion 1 and the inner mold 4 extending along a front-to-back direction, the shielding shell 6 is electrically connected to the shield layer 2102 via the collar 3 and the conductive pad 7;

(6) Fit the back cover 5 to the cable 2 before the cable 2 is electrically connected to the mating portion 1, after the inner mold formed, slid the back cover 5 forward along the cable 2 to the rear end of the inner mold 4 and assembled the back cover 5 with the inner mold 4.

Figure 12:
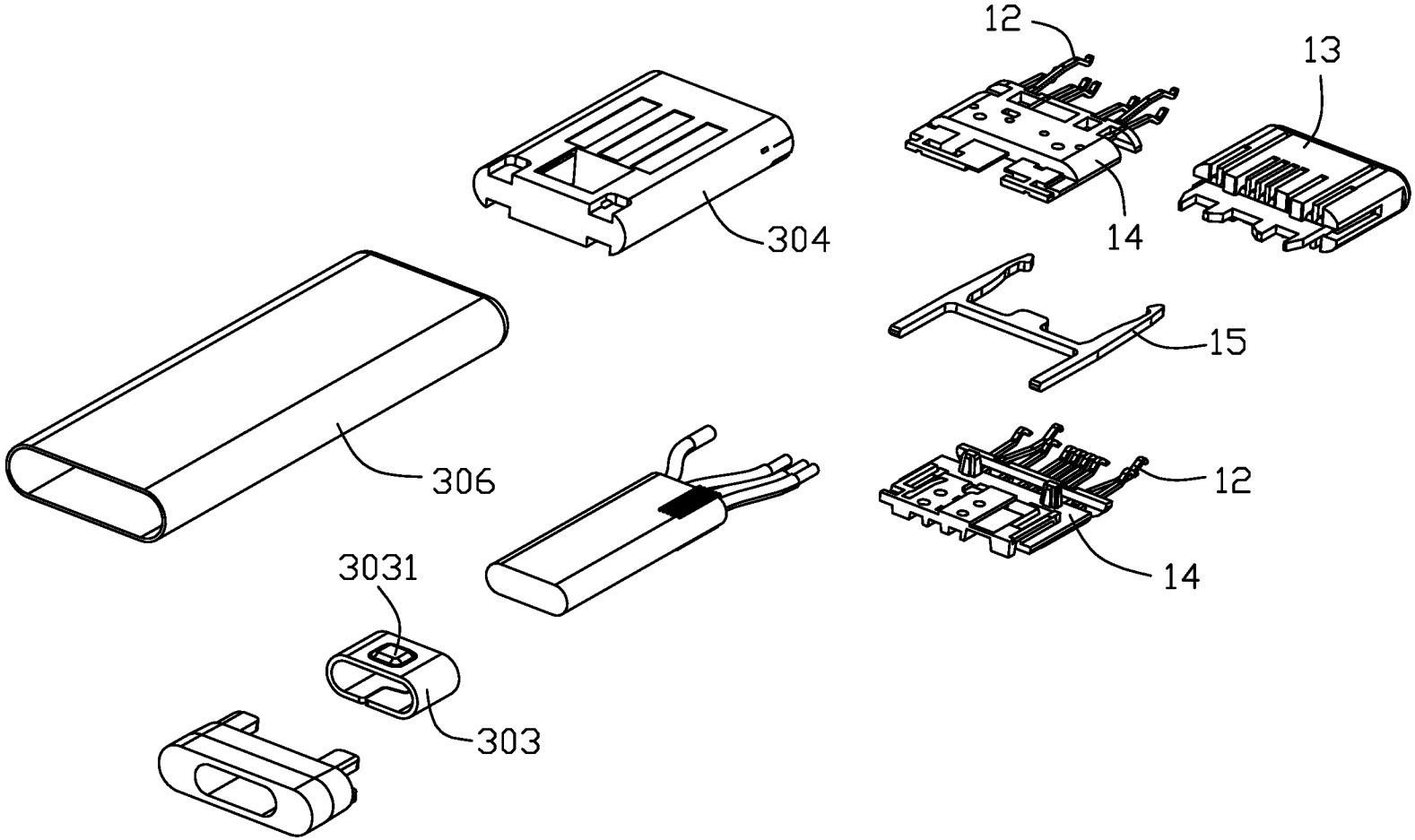
FIG. 12 is an exploded view of a cable connector assembly according to a second of embodiment the present invention.
Figure 13:
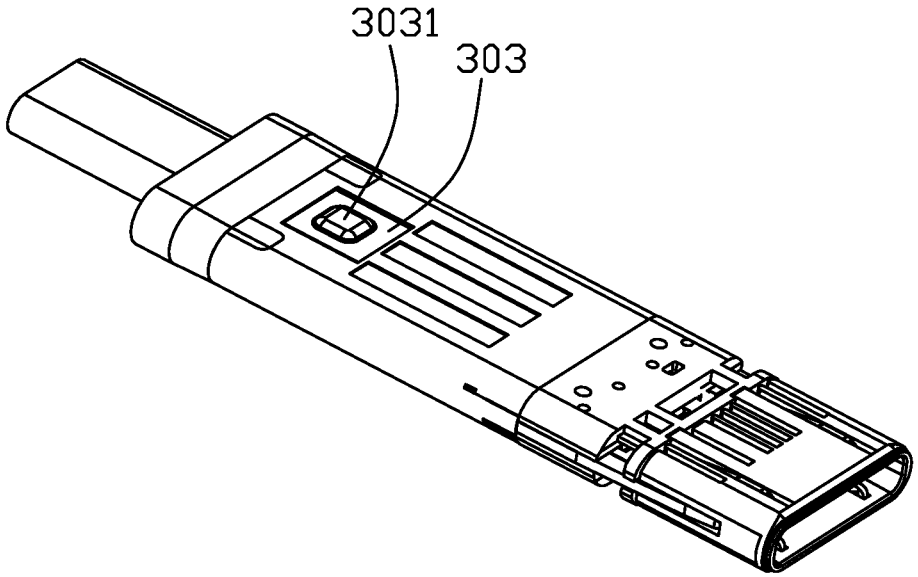
FIG. 13 is a perspective view of before the cable assembly mounted on the shielding shell as shown in FIG. 12.
Figure 14:
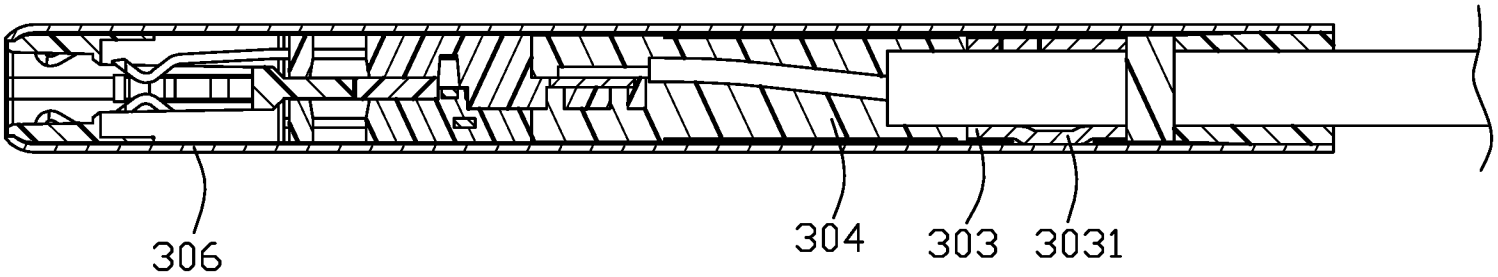
FIG. 14 is a cross-sectional view of the cable assembly taken along line 14-14 of FIG. 12.

Referring to FIGS. 12-14, the cable connector assembly 300 of the second embodiment of the present invention, the main difference between this embodiment and the first embodiment is that the conductive sheet 7 is not provided separately. In second embodiment of the present invention, one side of the collar 303 is provided with a tuber 3031 formed by punching. When the inner mold 304 is formed, the tuber 3031 is exposed to the outside of the inner mold 304 so as to be electrically connected with shielding shell 306 after the shielding shell 306 is mounted. It is noted that similar to the previous embodiment, the mating portion 1 essentially includes a front base part 13 in which the front opening 10 is formed, and a pair of terminal modules 14 stacked with each other in which the terminals 12 are integrally secured within the corresponding insulator, wherein a metallic latch 15 is retained between the front base part 13 and the pair of terminal modules 14. Notably, the contacting sections of the terminals 12 and the hooks of the latch 15 extend into the front opening 10.

Figure 15:
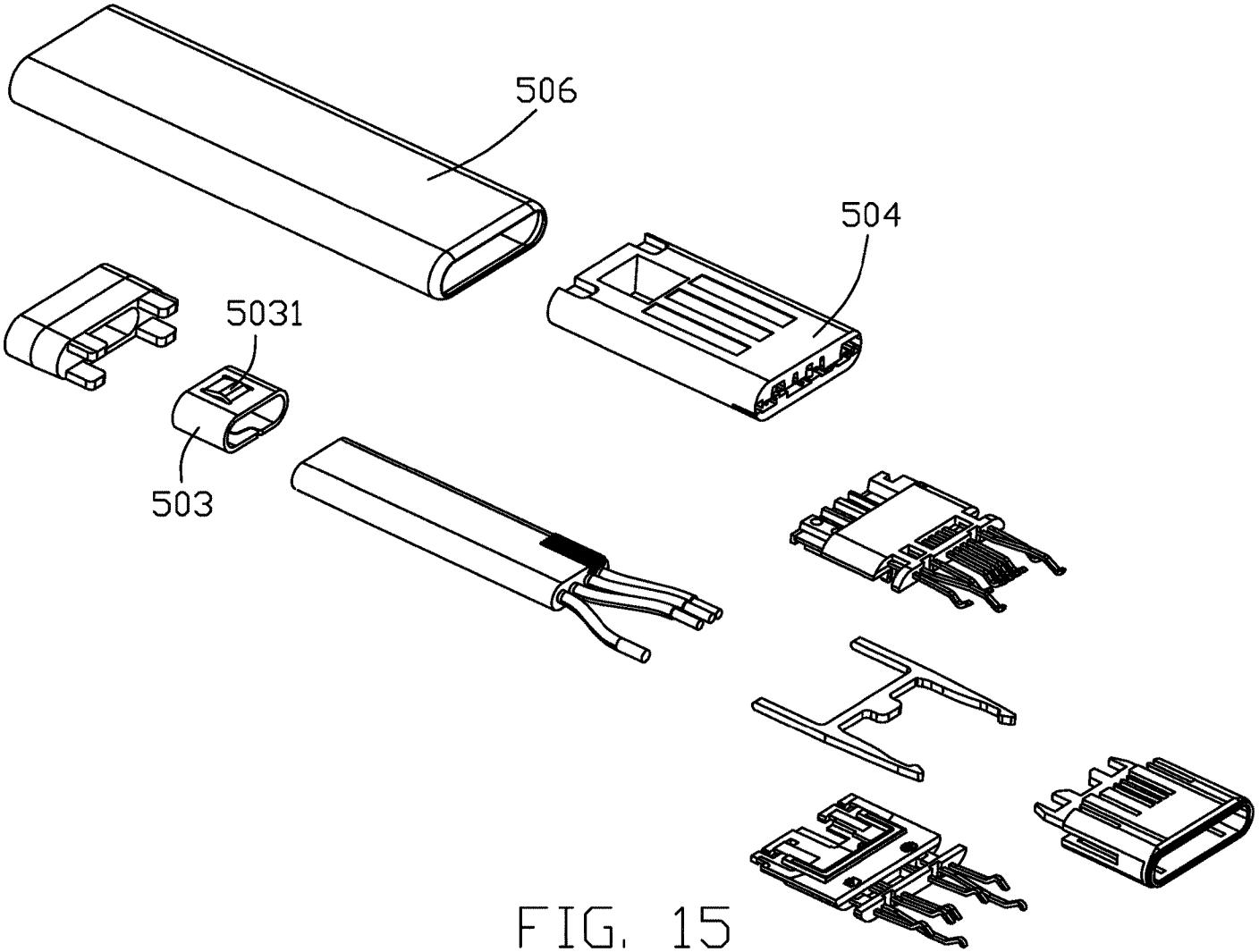
FIG. 15 is an exploded view of a cable connector assembly according to a third of embodiment the present invention.
Figure 16:
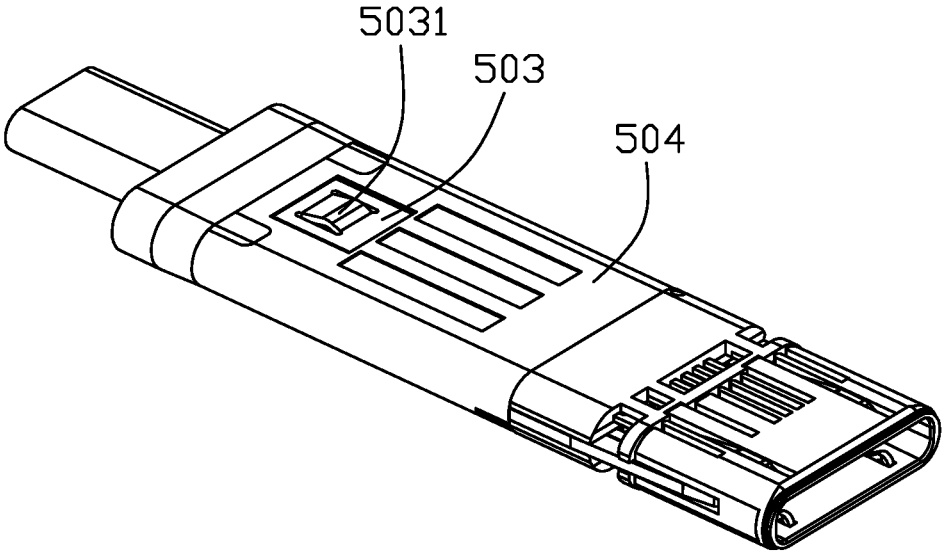
FIG. 16 is a perspective view of before the cable assembly mounted on the shielding shell as shown in FIG. 15.
Figure 17:
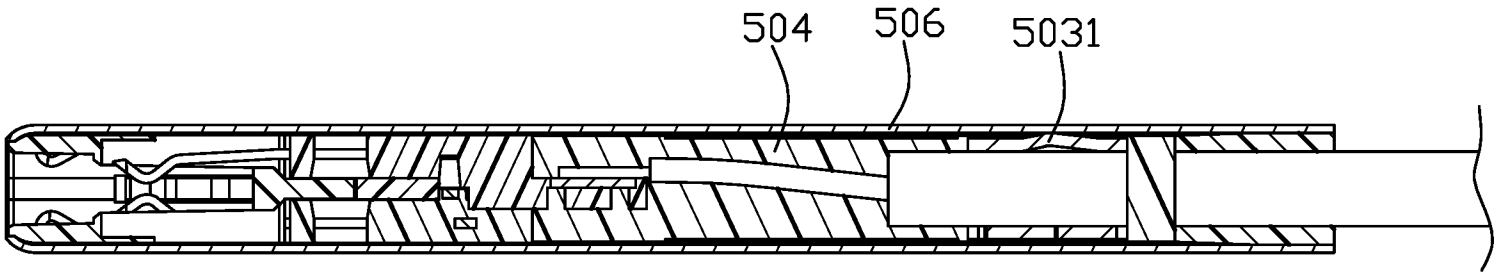
FIG. 17 is a cross-section view of the cable assembly taken along line 17-17 of FIG. 15.

Referring to FIGS. 15-17, the cable connector assembly 300 of the third embodiment of the present invention, the main difference between this embodiment and the second embodiment is that the collar 503 is provided with a spring tab 5031 formed by shearing or tearing the collar 503. After the inner mold 304 is formed, the spring tab 5031 is exposed to the outside of the inner mold 304 so as to be electrically connected with shielding shell 306.

The first core 211 having a larger diameter in the cable connector assembly 100, 300, 500 of the present invention uses a bare conductor structure. Both of the power core 2100 of the power wire 210 and the signal detection core 2120 of the signal detection wire 212 have a smaller diameter and include the insulative layer 2101, 2121. So that the structure of the flat cable 2 can be minimized, thereby facilitating thinning of the cable connector assembly 100, 300, 500.

Figure 18:
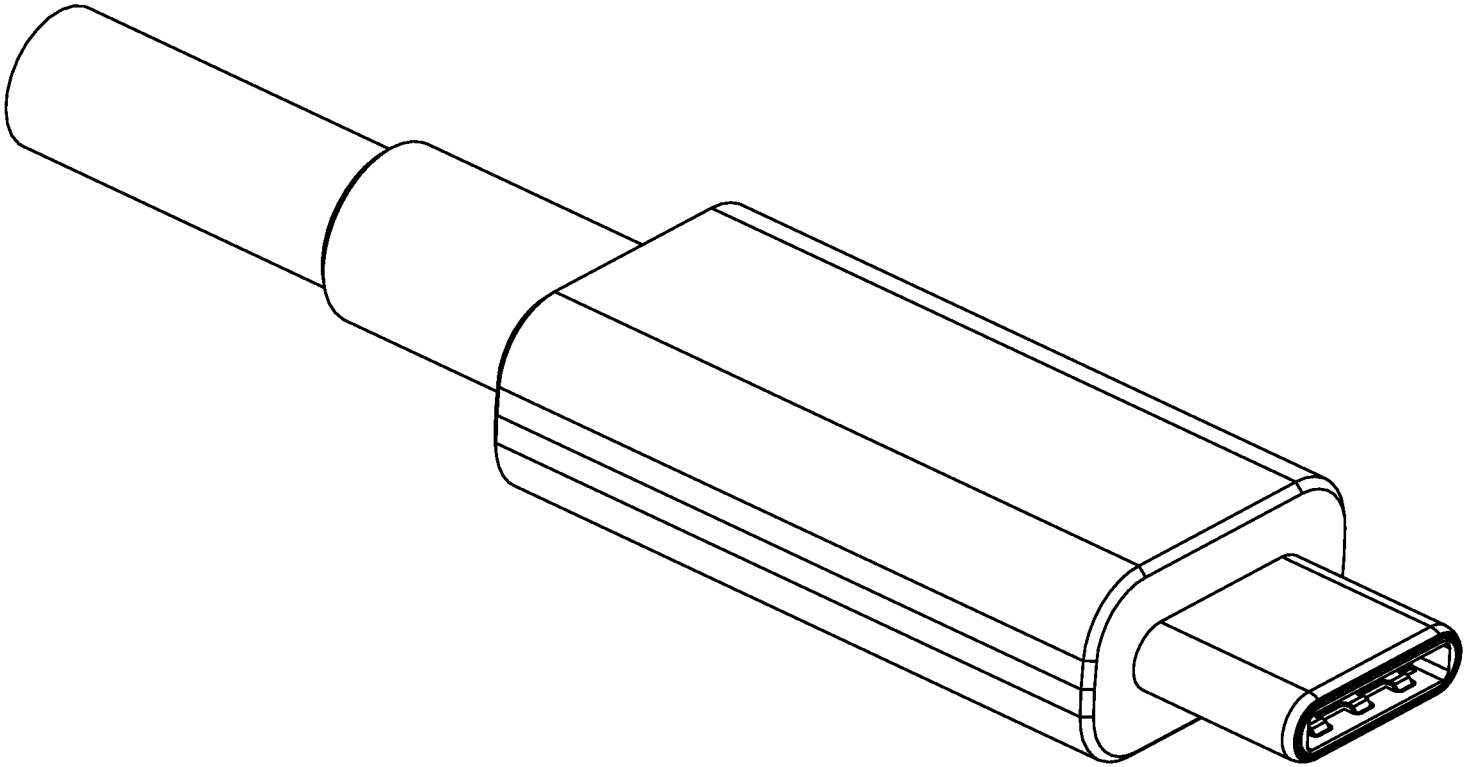
FIG. 18 (Related Art)
FIG. 18 is a perspective view of a traditional plug cable USB type C connector.
Figure 19:
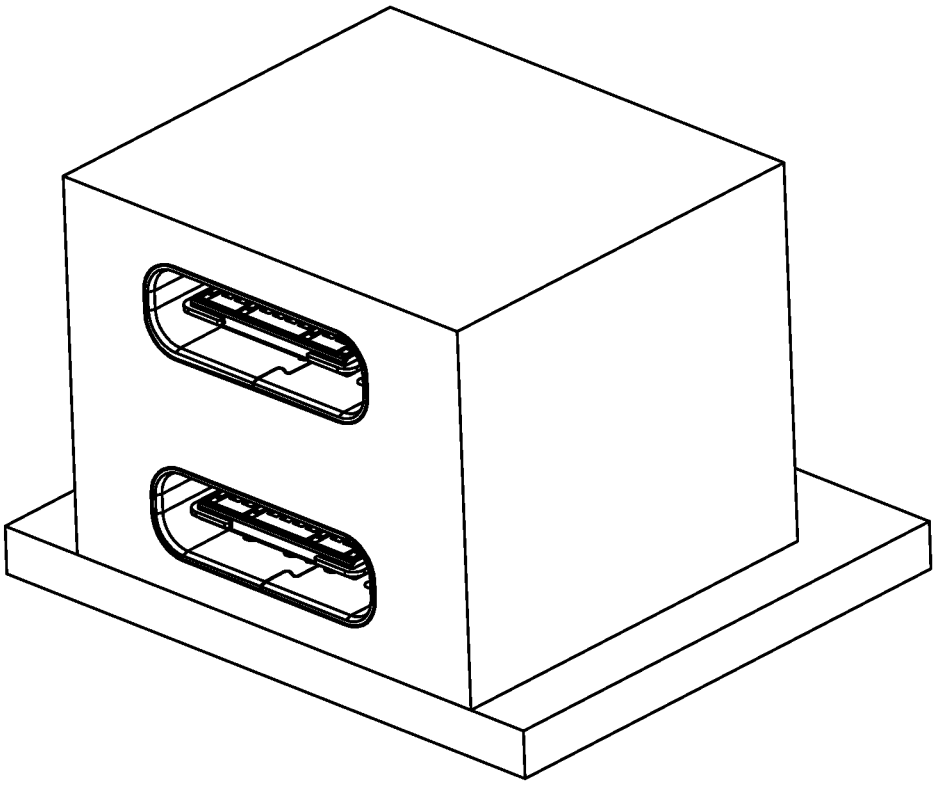
FIG. 19 (Related Art)
FIG. 19 is a perspective view of a traditional double deck receptacle USB type C connector.

Understandably, the feature of the invention is to provide the whole cable connector assembly with a thin dimension, in the vertical direction, similar to the mating port is inserted into the mating cavity of the corresponding receptacle connector mounted upon a printed circuit board in a portable electrical device. Notably, most traditional plug/cable USB Type C connector as shown in FIG. 18 which is derived from FIG. 8 of U.S. Pat. No. 9,490,594 with the same applicant, wherein the holding portion is thicker than the front mating port/portion which is adapted to be inserted into the mating cavity of corresponding receptacle USB type C connector as shown in FIG. 1 of the aforementioned U.S. Pat. No. 9,490,594. Based upon this structure, a double deck receptacle connector assembly for use with two plug/cable connectors, is required to have the mating cavities of those two receptacle connectors spaced from each other with a relatively significant distance in the vertical direction to forgive the relatively large/thick holding portions of the two plug/cable connectors, as shown in FIG. 19 which is derived from FIG. 29(B) of the aforementioned U.S. Pat. No. 9,490,594, thus failing to achieving a low profile double deck receptacle connector assembly used in a compact portable electrical device disadvantageously.

Figure 20:
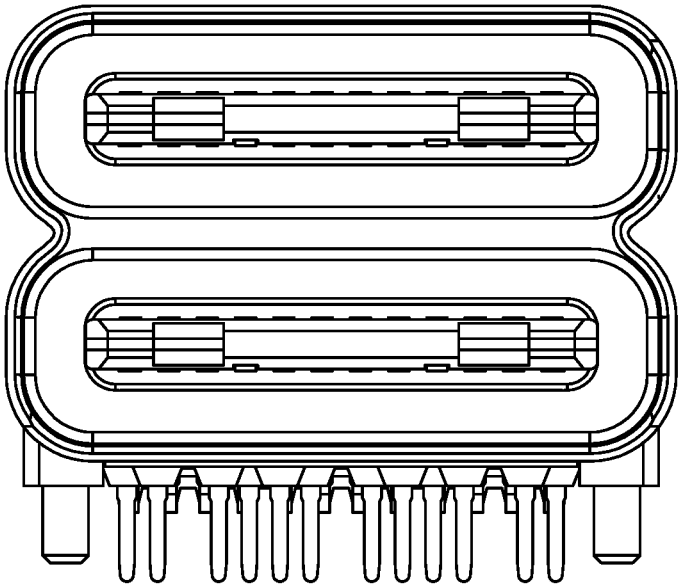
FIG. 20 (Related Art)
FIG. 20 is a perspective view of a hypothetical thin double deck receptacle USB type C connector.
Figure 21:
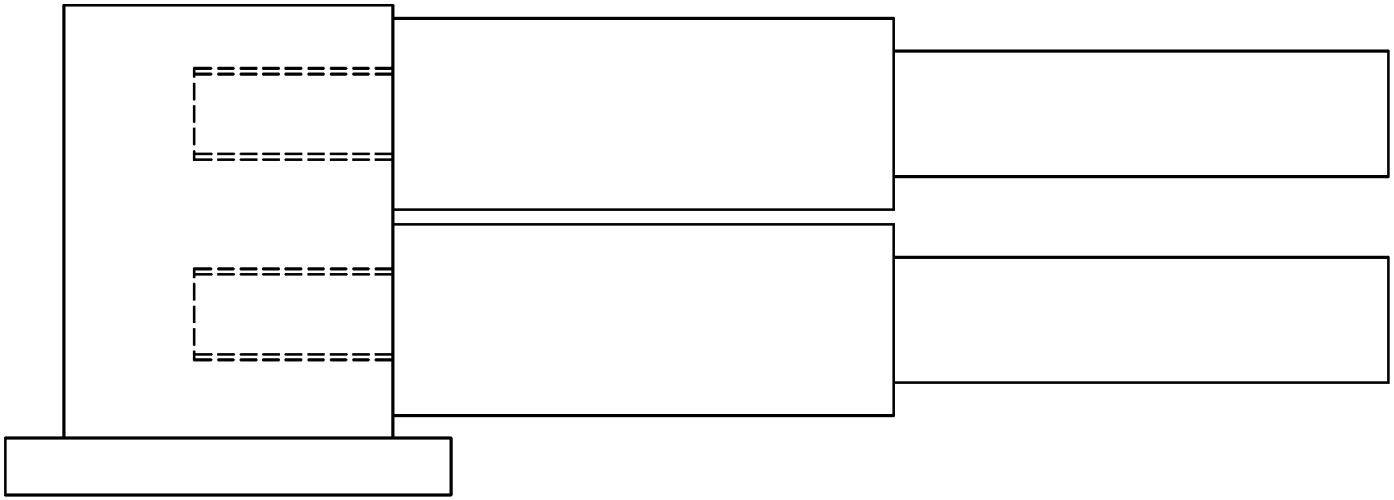
FIG. 21 is a side view to show the traditional plug/cable USB type C connectors used with the traditional double deck receptacle USB type C connector.
Figure 22:
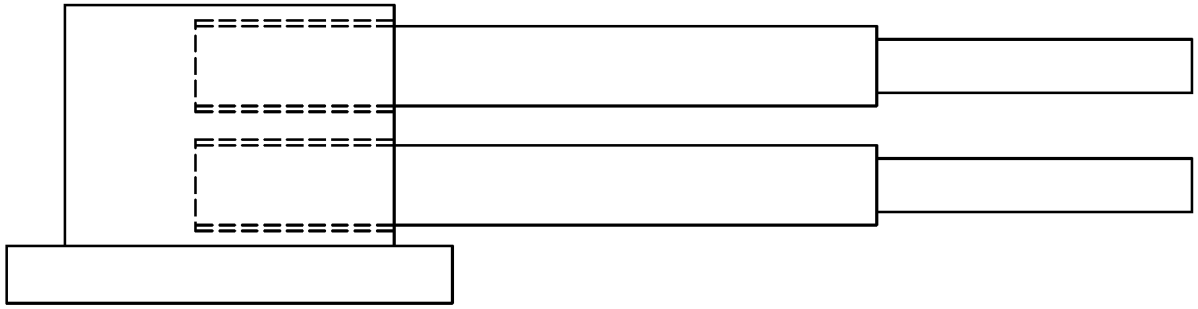
FIG. 22 is a side view to show the plug/cable SUB type C connectors of the invention used with the hypothetical thin double deck receptacle USB type C connector of FIG. 20.

In opposite, in the instant invention, because the plug/cable connector intentionally thins the holding portion by cooperation with a flat cable linked therewith, the holding portion is now dimensioned as thin as the front mating port/portion, thus allowing two plug/cable connectors to be used within a receptacle connector assembly having a low profile in the vertical direction, i.e., a minimum distance (around few times of the thickness of the shell of the receptacle connector) between the two vertically closely arranged mating cavities of the two receptacle connectors in the vertical direction, as shown in FIG. 20 which is hypothetically arranged/designed for illustration by following the same concept of U.S. Pat. Publication No. 2016/0329662 with the same applicant. FIGS. 21 and 22 show comparison of the mated plug and receptacle connector assembly between the traditional design (FIG. 21) and the invention (FIG. 22) with different profiles in the vertical direction. Understandably, in the invention the whole shielding shell 6 has the constant vertical dimension along the front-to-back direction wherein the rear section of the shielding shell 6 is used as the holding portion for the user while the front section of the shielding shell 6 is used to be inserted into the corresponding mating cavity in the complementary receptacle connector. In this embodiment, the flat cable 2 has a transverse dimension in the transverse direction smaller than that of the shielding shell 6, and a vertical dimension in the vertical direction smaller than that of the shielding shell 6, thus assuring no conflict occurring between the two plug/cable connectors in the vertical direction when two plug/cable connectors are simultaneously used in a low profile double deck receptacle connector assembly as shown FIGS. 20 and 22. It is also noted that the cable/plug USB type C connector is used with two orientations in a flippable manner because of the two rows terminals transmitting similar signals/powers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A cable connector assembly comprising:

a mating portion;

a flat cable electrically connecting with the mating portion, the flat cable comprising a plurality of wires and an outer boot enclosing the wires, the wires comprising a first wire and a second wire;

an inner mold enclosing a part of the mating portion and a part of the flat cable; and a shielding shell enclosing the inner mold; wherein the first wire is a core wire directly enclosed by the outer boot; and the second wire comprises a core wire and an insulative layer enclosing the associated core wire.

2. The cable connector assembly as claimed in claim 1, wherein the second wire comprises a pair of power wires, and the power wire has a shield layer enclosing the insulative layer.

3. The cable connector assembly as claimed in claim 1, wherein the shielding shell has a same cross section in the whole front-to-back direction, and the shielding shell encloses the periphery of mating portion and inner mold in a front-to-back direction.

4. The cable connector assembly as claimed in claim 1, further comprising a back cover mounted at a rear of the inner mold, and wherein the shielding shell encloses the periphery of back cover in a front-to-back direction.

5. The cable connector assembly as claimed in claim 2, wherein the shield layer comprises a plurality of spiral wires extending along the power wires.

6. The cable connector assembly as claimed in claim 5, further comprising a collar, and wherein the shield layer has an exposed part turned out of the outer boot, and the collar crimps the exposed part and electrically connects with the shield layer and the shielding shell.

7. The cable connector assembly as claimed in claim 6, wherein the collar has a tuber, the tuber exposing out the inner mold to electrically connect with the shielding shell.

8. The cable connector assembly as claimed in claim 6, wherein the collar has an integral spring tab exposing out of the inner mold for electrically connecting with the shielding shell.

9. The cable connector assembly as claimed in claim 6 further comprising a conductive pad, and wherein the inner mold has an opening for exposing the collar, and the shielding shell, the collar, and the shielding layer are all electrically connected via the conductive pad.

10. The cable connector assembly as claimed in claim 4, wherein the inner mold defines a notch, and the back cover has a cantilever beam mounted in the notch.

11. A cable connector assembly comprising:

a mating portion having a front opening forwardly communicating with an exterior along a front-to-back direction, and including a plurality of terminals arranged in two rows opposite to each other in a vertical direction perpendicular to the front-to-back direction with front contacting sections exposed in the opening and rear tails along the front-to-back direction;

a flat cable located behind the mating portion and having a plurality of wires to respectively electrically connect to the tails of the corresponding terminals;

an inner mold applied upon a rear part of the mating portion and a front part of the flat cable; and a shielding shell enclosing both the mating portion and the inner mold; wherein the shielding shell defines, in the vertical direction, a maximum vertical dimension which is close to that defined by said mating portion; and said shielding shell has, along the front-to-back direction, constant dimensions in both the vertical direction and a transverse direction perpendicular to both said front-to-back direction and the vertical direction.

12. The cable connector assembly as claimed in claim 11, wherein said shielding shell is metallic.

13. The cable connector assembly as claimed in claim 12, wherein some of said wires have corresponding shielding layers exposed to electrically connect to the shielding shell.

14. The cable connector assembly as claimed in claim 13, further including means for electrically connecting the shielding layers to the shielding shell.

15. The cable connector assembly as claimed in claim 11, further including a back cover located behind the inner mold and within the shielding shell, through which the flat cable extends rearwardly.

16. A cable connector assembly comprising:

a mating portion having a front opening forwardly communicating with an exterior along a front-to-back direction, and including a plurality of terminals arranged in two rows opposite to each other in a vertical direction perpendicular to the front-to-back direction with front contacting sections exposed in the opening and rear tails along the front-to-back direction;

a flat cable located behind the mating portion and having a plurality of wires to respectively electrically connect to the tails of the corresponding terminals;

an inner mold applied upon a rear part of the mating portion and a front part of the flat cable; and a shielding shell enclosing both the mating portion and the inner mold; wherein the shielding shell defines, in the vertical direction, a maximum vertical dimension which is close to that defined by said mating portion;

said shielding shell is metallic; and some of said wires have corresponding shielding layers exposed to electrically connect to the shielding shell.

* * * * *